US005231922A

United States Patent [19]

Hartmann

[11] Patent Number: 5,231,922

[45] Date of Patent: Aug. 3, 1993

[54] PROCESS FOR CONTROL OF EXTRACTION OF JUICE FROM ORGANIC PRODUCTS

[75] Inventor: Eduard Hartmann, Schneisingen, Switzerland

[73] Assignee: Bucher-Guyer AG Maschinenfabrik, Niederweningen, Switzerland

[21] Appl. No.: 878,430

[22] Filed: May 4, 1992

Related U.S. Application Data

[63] Continuation of Ser. No. 283,321, Dec. 16, 1988, abandoned.

[30] Foreign Application Priority Data

Mar. 5, 1987 [CH] Switzerland ..... 823/87

[51] Int. Cl.[5] ..... B30B 9/02

[52] U.S. Cl. ..... 100/37; 100/48; 100/99; 100/104; 426/489

[58] Field of Search ..... 100/37, 43, 48, 99, 100/104, 107, 110, 113, 116, 117, 125-129, 131, 213; 73/215; 137/101.27, 486, 487.5; 426/478, 489

[56] References Cited

U.S. PATENT DOCUMENTS

| | | | |
|---|---|---|---|
| 1,132,994 | 3/1915 | Alger | 73/215 X |
| 1,218,643 | 3/1917 | Gamble | 73/215 |
| 1,843,552 | 2/1932 | Gibson et al. | 73/215 X |
| 3,513,769 | 5/1970 | Sutter-Christ | 100/107 |
| 4,582,568 | 4/1986 | Iyengar | 100/117 X |

FOREIGN PATENT DOCUMENTS

| | | | |
|---|---|---|---|
| 2253468 | 7/1975 | France | 100/37 |
| 2411699 | 7/1979 | France | 100/43 |
| 55-86697 | 6/1980 | Japan | 100/104 |
| 55-88999 | 7/1980 | Japan | 100/37 |
| 662367 | 5/1979 | U.S.S.R. | 100/43 |
| 937513 | 6/1982 | U.S.S.R. | 100/104 |

*Primary Examiner*—Stephen F. Gerrity
*Attorney, Agent, or Firm*—Edmund M. Jaskiewicz

[57] ABSTRACT

A process for controlling a press for the extraction of juice from agricultural products, in which the pressing stroke of a pressing cycle is ended at the earliest when the maximum average juice output occurs. This process can be performed using a juice discharge arrangement of a press in which is connected a flowmeter as a sensor, which in turn is connected to a device controlling the drive elements of the press.

7 Claims, 3 Drawing Sheets

PROCESS FOR CONTROL OF EXTRACTION OF JUICE FROM ORGANIC PRODUCTS

This application is a continuation of application Ser. No. 07/283,321, filed Dec. 16, 1988, now abandoned.

FIELD OF THE INVENTION

The present invention relates to a process for control of extraction of juice from organic products using a press, which is provided with a pressing space having a drain device and a drivable pressing element in the pressing space.

DESCRIPTION OF THE PRIOR ART

For this purpose, mechanically, pneumatically or hydraulically operated presses have generally been used, and the pressing element is mainly a piston or flexible membrane. The entire pressing process consists of several pressing cycles performed in consecutive intervals.

During a pressing cycle, the pressing element is initially and then constantly pressed against the mash present in the pressing space and then is withdrawn into a rest position. During this return stroke movement the mash of the fruit, grapes or similar crops is loosened, for example, by rotation of the press container during a certain period.

In this batch mode of operation, time which must be spent on the mash charge from which juice is to be extracted is decisive in determining the economical use of a press.

Economical use means a high juice yield in the shortest possible total time for the process while avoiding harmful effects on the juice obtained.

Because the objective of such a process is affected by numerous parameters, it must be clearly defined.

SUMMARY OF THE INVENTION

It is, therefore, the object of the present invention to achieve a high economical use by providing a process for control of juice extraction from organic, mainly agricultural products such as fruit, vegetables, grapes or similar crops by a press, which results in a high juice yield in a relatively short total detention time and without loss of quality.

The invention also discloses the performance of ideal juice extraction processes and saving of energy and wear on the equipment.

According to the invention this object is achieved by ending the pressing stroke of a pressing cycle at the earliest when the maximum output of juice obtained during this pressing cycle has been reached.

The pressing cycle lasts from stopping of the pressing stroke of the previous pressing cycle and includes the return stroke of the pressing element as well as any possible loosening phase and the pressing stroke of this pressing cycle.

After filling of the press, the process according to the invention involves the first pressing cycle only to the extent that its pressing stroke ends immediately on reaching the maximum average juice output and at this point, the procedure according to the process begins.

The period of a pressing cycle depends on the maximum average juice output of two successive pressing cycles, and the average juice output of the obtained juice output in the cycle time used for this purpose corresponds to the average value.

The next pressing cycle begins by starting the return stroke of the pressing element after the ending of the present pressing stroke.

The maximum average juice output LQ of a pressing cycle is calculated from the amount of juice Q per unit of time obtained during a specific time. The amount of juice increases greatly at the beginning of the pressing stroke and, because of the decreasing pressability of the pressing material, then reaches the maximum value of the juice output. At this critical point, an optimal economic efficiency in each individual pressing cycle has been reached.

Another improvement of the economic efficiency over several pressing cycles is the extraction of juice from agricultural products, which has been confirmed by tests, and can be obtained if the pressing stroke of a pressing cycle is not ended until the maximum average juice output LQ ($K_O \ldots K_X$) obtained from this pressing cycle is reached. This general definition takes into account the next following pressing cycle whose maximum average juice output, according to experience, is below that of the previous cycle, and reduces the juice output difference of the two pressing cycles in favor of the economic efficiency of the process.

Another advantageous result can be achieved if the pressing stroke of a pressing cycle is not ended after the expected maximum average juice output LQ ($K_Y$) of the next pressing cycle, as a result of which the gentle treatment of the mash is taken into account.

It has proved optimal to end the pressing stroke of a pressing cycle when the momentary juice output $\dot{Q}$ reaches the expected maximum average juice output LQ of the next pressing cycle, so that overpressing of the mash can be avoided under favorable economic conditions. These procedures are based on the comparison of the momentary juice output with the expected maximum average juice output of the next pressing cycle and are extremely well suited for juice extraction of fruit, crops, grapes or other agricultural products.

As a device, a press is advantageous comprising a structure in which the juice discharge arrangement or the juice collection device has a measuring device which determines the amount of juice leaving the press, and in turn is connected to a processor which is connected to a device controlling the drive elements of the press.

BRIEF DESCRIPTION OF THE DRAWINGS

Other details and advantages of the invention appear from the following description and the drawing, in which reference is expressly made regarding all the details not described in the text. There are shown in.

DESCRIPTION OF THE PREFERRED EMBODIMENTS

Figure 1:
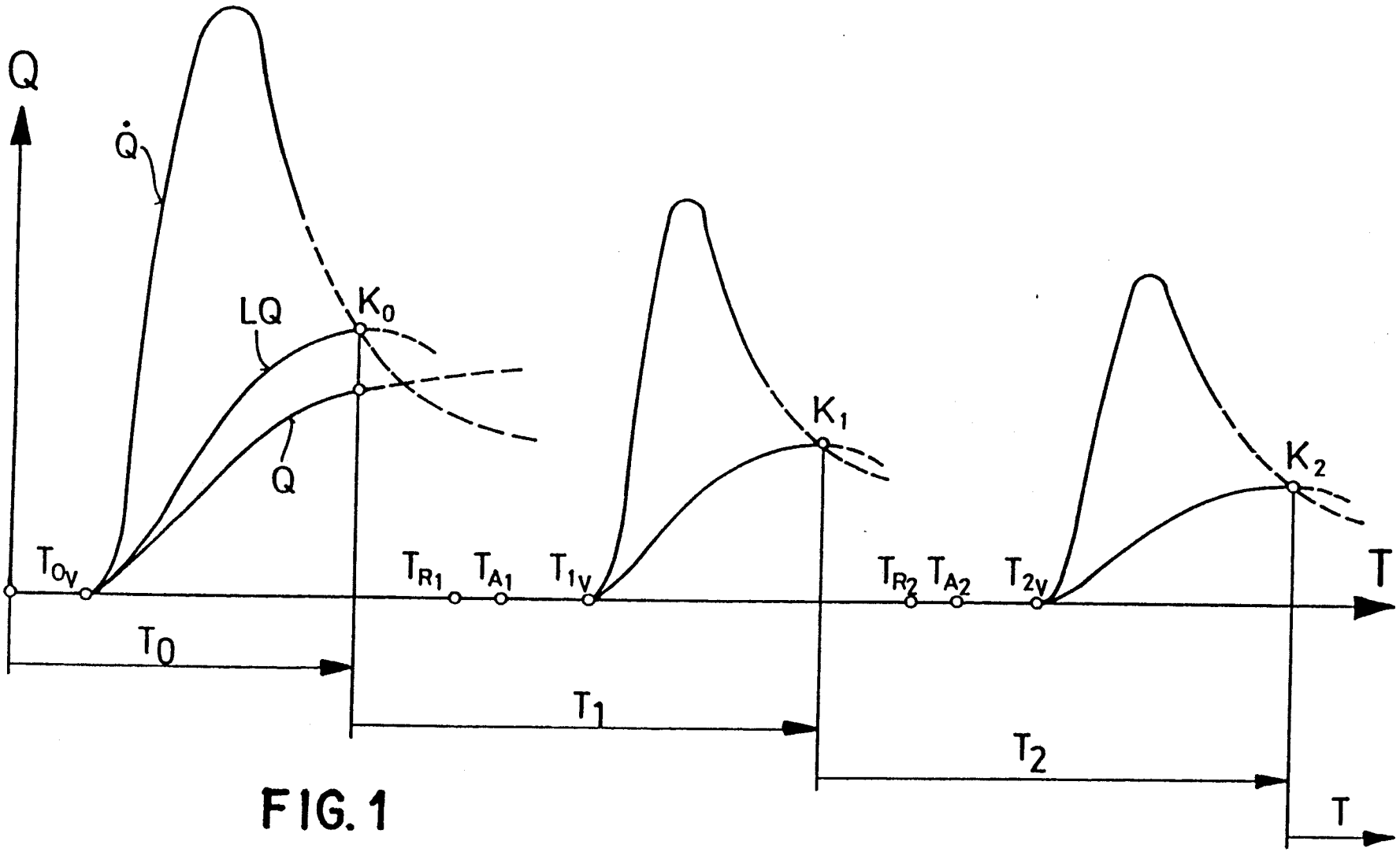
FIG. 1 shows a diagrammatic representation of the process according to the invention.

FIG. 1 shows in graphic representation the course of the process for control of extraction of juice from organic products, especially fruit, crops, grapes or similar agricultural products by means of a press, by an amount (Q)−/time (T) diagram. During the first pressing cycle, the pressing element moves within time $T_o$ from a rest position against the mash and continues in the pressing position until the maximum average juice output LQ from this pressing cycle has been reached. The juice yield initially increases more and later flattens out, and the amount of juice Q continuously increases, while, on the other hand, average amount of juice, i.e., the average amount of juice achieved at the assumed moment after reaching its maximum value proceeds at a decreasing rate. In addition to these parameters, the curve of momentary juice output $\dot{Q}$ initially has a steep rise, and after reaching its maximum output falls off with nearly the same steepness so as to be asymptotic. Below the apex of the $\dot{Q}$ curve is the change point on the average juice output curve, at which the increasingly rising average juice output changes into a flatter section in relation to the apex and then again falls off. The apex is at the same time the interface of average juice output LQ and momentary juice output $\dot{Q}$, which is determined by a flowmeter and computer. At this moment, the pressing process is terminated and the next pressing cycle can begin. The latter begins with the withdrawal of the pressing element and is represented in FIG. 1 in the time interval $T_1$. Even during the withdrawal of the pressing element, the loosening of the mash can occur, for example, by rotation of the press container. Withdrawal of the pressing element in FIG. 1 is identified by symbol $T_R$ and loosening by $T_A$. The duration of the individual pressing cycles depends on the course of the process; it is variable. With increasing pressing cycles the momentary juice output is reduced.

Figure 2:
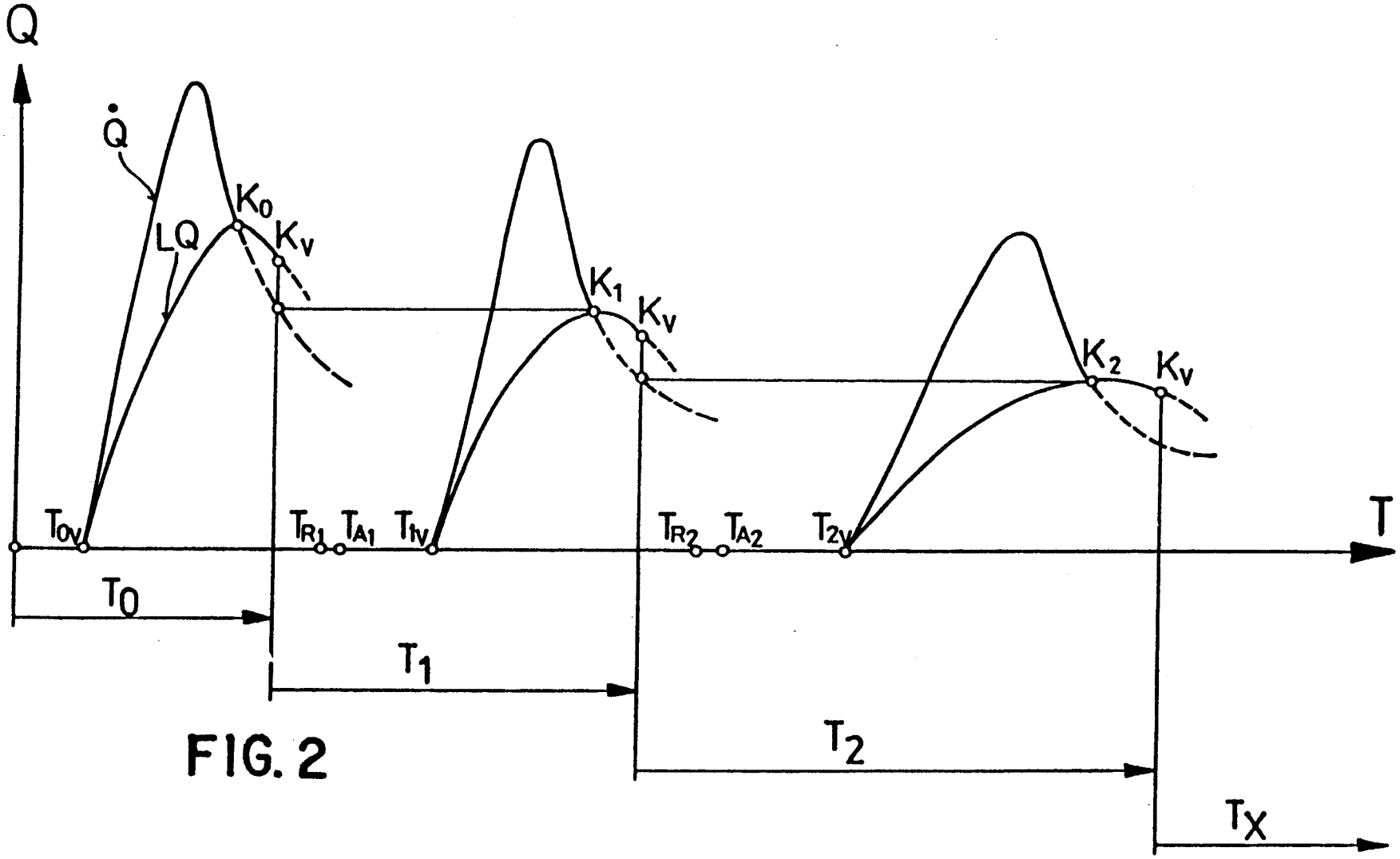
FIG. 2 shows a diagrammatic representation of the process according to the invention in an improved embodiment.

FIG. 2 represents the process according to the invention in which the beginning of the pressing cycle is delayed in comparison with the procedure of FIG. 1, i.e. the return stroke of the pressing element takes place after the maximum average juice output has been reached. This relationship is based on the fact that in the course of the pressing process the respective juice outputs of the pressing cycles are reduced. To avoid a great drop of the juice output adversely affecting the economic efficiency of the pressing process, it can be achieved by a shutdown or a return stroke movement—begun after the maximum value has been reached—of the average juice outputs on the next pressing cycle and this procedure must be based on the probability of occurring empirical values In this connection, it can be noted that by time delay $K_V$ there is no decrease below the maximum average juice output value expected from the next pressing cycle As an alternative, the pressing stroke of a pressing cycle can be ended, when momentary output $\dot{Q}$ agrees with the expected maximum average juice output of the next pressing cycle.

A press of known type can be used as the apparatus for carrying out the process according to the invention. On its juice output structure, a flowmeter is connected as a generator of a processor, which, when adapted to the prevailing conditions of the process, controls the drive elements of the press.

Figure 3:
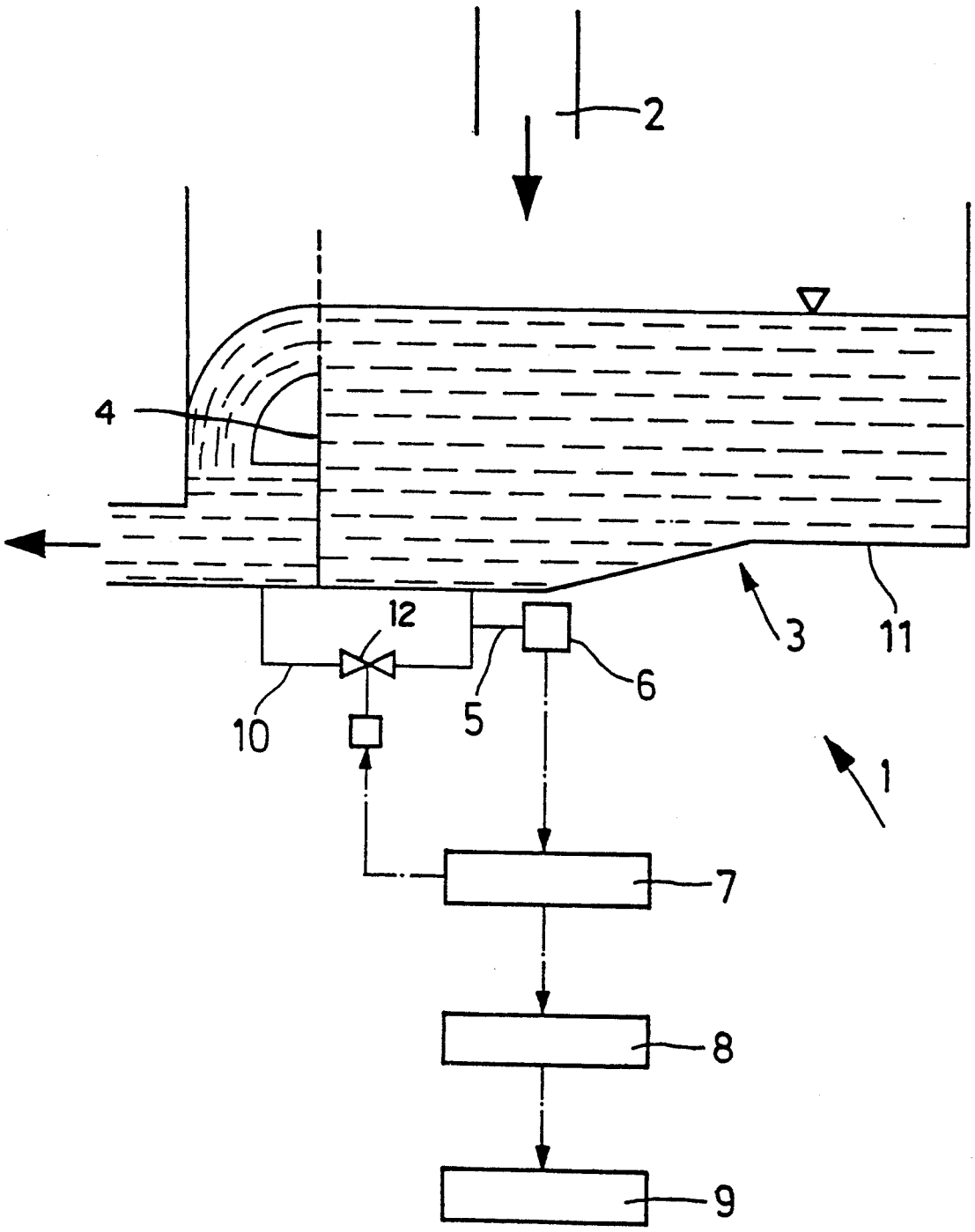
FIG. 3 shows a schematic representation of the apparatus according to this present invention.

As seen in FIG. 3, a collection tank 3 or similar container, has a wall 4 constructed as an overflow, which can be connected to discharge arrangement 2 of the press, to function as a flowmeter. On a measuring pipe 5, emptying from the underside of collection tank 3, there is a pressure measuring device 6 as sensor, which measures the level changes occurring during the individual pressing cycles and relays them to a processor 7. A float, ultrasonic or a pressure element on the bottom of the collection tank 3 could be used for measuring the level changes in the collection tank. On the basis of the values recorded by the processor, influence is exerted on the drive elements of press 9 by control 8. At the end of each pressing cycle, the collection tank 3 is emptied through a separate pipe 10, and for this purpose a slide valve 12, which can be operated by the processor or by hand, is provided. Collection tank 3 itself has a bottom portion 11 which is set back upward so that the juice can continue to flow into the area of measuring pipe 5.

It will be understood that this invention is susceptible to modification in order to adapt it to different usages and conditions, and accordingly, it is desired to comprehend such modifications within this invention as may fall within the scope of the appended claims.

I claim:

1. A process for controlling the extraction of juice from organic products comprising the steps for placing the organic products from which juice is to be extracted into a pressing space of a press having a pressing element and a drain device in the pressing space, moving the pressing element in a pressing stroke of a pressing cycle against the organic products in the pressing space to press juice therefrom, subjecting the organic products in the pressing space to a plurality of pressing cycles to define the process, determining continuously the average juice output being obtained during the pressing stroke of said pressing cycle, and ending the pressing stroke of said pressing cycle only after the maximum average juice output is obtained but before the momentary juice output obtained decreases to the maximum average juice output expected from the next successive pressing cycle.

2. A process as claimed in claim 1 wherein said pressing cycle comprises the pressing stroke and a return stroke of the next successive pressing cycle after said pressing cycle and return stroke has ended.

3. A process as claimed in claim 2 and initiating a return stroke of the pressing element of a next pressing cycle after a pressing stroke has ended.

4. A process as claimed in claim 1 and further comprising the step of determining a duration of a pressing cycle based on the maximum average juice output of two successive pressing cycles.

5. A process as claimed in claim 1 and ending the pressing stroke of a pressing cycle immediately after the maximum average juice output obtained during said pressing cycle is reached

6. A process as claimed in claim 5 and ending the pressing stroke of a pressing cycle before reaching an expected maximum average juice output of the following pressing cycle which is less than the amount of the average juice output in the previous pressing cycles.

7. A process as claimed in claim 5 and ending the pressing stroke of a pressing cycle immediately before the momentary juice output reaches an expected maximum average juice output of the next pressing cycle.

* * * * *